US005205234A

United States Patent [19]

Schoell

[11] Patent Number: 5,205,234

[45] Date of Patent: Apr. 27, 1993

[54] ANCHOR AND WINCH

[76] Inventor: Harry L. Schoell, 2698 S.W. 23rd. Ave., Ft. Lauderdale, Fla. 33312

[21] Appl. No.: 782,484

[22] Filed: Oct. 25, 1991

[51] Int. Cl.[5] ..... B63B 21/22

[52] U.S. Cl. ..... 114/210; 114/294

[58] Field of Search ..... 114/294, 210, 301, 304, 114/310

[56] References Cited

U.S. PATENT DOCUMENTS

| | | | |
|---|---|---|---|
| 735,985 | 8/1903 | Kidd | 114/310 |
| 2,903,989 | 9/1959 | Winslow | 114/210 |
| 3,106,180 | 10/1963 | Rice | 114/210 |
| 4,173,938 | 11/1979 | Colin | 114/301 |

*Primary Examiner*—Jesus D. Sotelo

*Attorney, Agent, or Firm*—John B. Dickman, III

[57] ABSTRACT

A bow anchor system which has a configuration of the bow of a boat to fit against the bow. The bow anchor has a triangular shape with a pair of wings which form a delta shape. An arm pivotally connected to the triangular shape is also connected to the anchor line for raising and lowering the anchor. A winch mechanism in the hull pays out and retrieves the anchor through a conduit in the bow of the boat.

7 Claims, 2 Drawing Sheets

ANCHOR AND WINCH

BACKGROUND OF THE INVENTION

The invention relates to a bow anchor mounted on the bow of a boat hull, and, in particular, a bow anchor having a configuration to resemble the shape of the hull and integrally fit therein when not in use.

The prior art patents disclose several types of retractable anchors which either retract into the hull or against it. The invention is particularly concerned with an anchor which is drawn up against the bow of a boat. The known patents do not suggest such an anchor arrangement. The only U.S. Patent of remote interest is U.S. Pat. No. 3,106,180, issued to Rice, which shows a bow anchor and a through hull conduit for retracting the anchor to the conduit. The anchor does not resemble the shape of the bow.

The other prior art patents include U.S. Pat. Nos. 1,912,366 - issued to Hausenfluck; 2,599,200 - issued to Rodgers; 2,937,610 - issued to Rutledge; and 3,279,411 - issued to Ellis. These patents all disclose drawing the anchor against the hull, but not against the bow. Other patents show retracting the anchor into the hull, these are U.S. Pat. Nos. 522,177, issued to Holland and 1,739,359, issued to Hausenfluck.

The prior art does not suggest a bow anchor similar to the invention where the anchor is drawn against the bow and assumes the configuration of the bow. Further, they do not suggest an anchor that is balanced to retain its vertical position as drawn against the bow or lowered to the ocean floor.

SUMMARY OF THE INVENTION

The invention provides a bow anchor with a plough-like blade and a pivotal arm. The blade has a triangular shape with a pair of wings which form a V-shape to match the shape of the bow hull. The pivotal arm is connected to a pivot connection with a stop to limit the pivotal movement of the arm.

The bow anchor is balanced to retain its vertical position when being retracted or lowered. The distribution of the mass of the wings and the location of the pivot arm and stop contribute to the stability of the anchor. In addition, the triangular shape aids the balance of the anchor, which directs the flow of water upwardly and outwardly over the wings of the plough-like blades.

A conduit mounted in the bow guides the anchor line into the hull where a winch mechanism controls the paying out and retraction of the anchor.

DETAILED DESCRIPTION OF THE INVENTION

Figure 1:
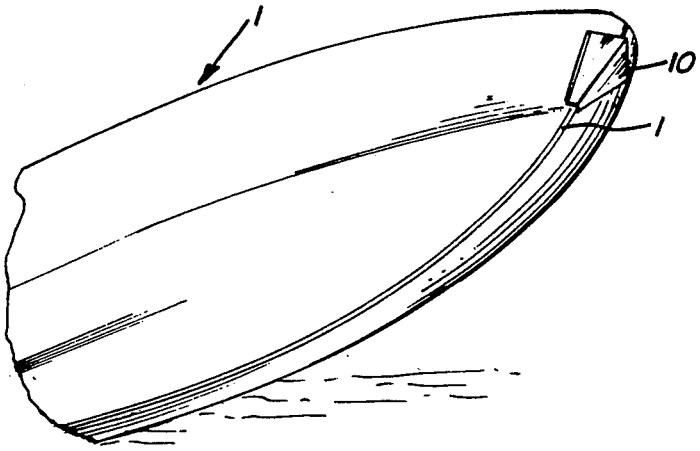
FIG. 1 is a perspective view of a boat hull with a bow anchor of the invention.
Figure 2:
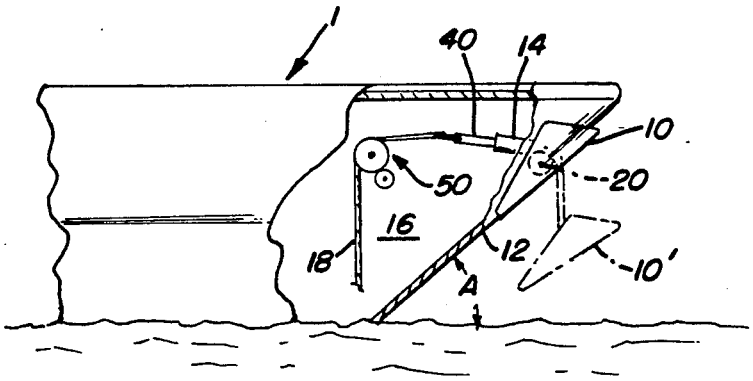
FIG. 2 is a side elevational view, partly in section, of a boat hull showing a bow anchor of the invention.
Figure 3:
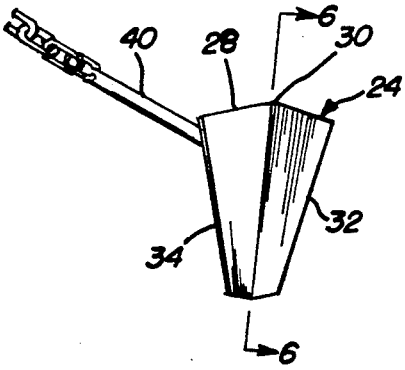
FIG. 3 is a front perspective view of a bow anchor of the invention.
Figure 4:
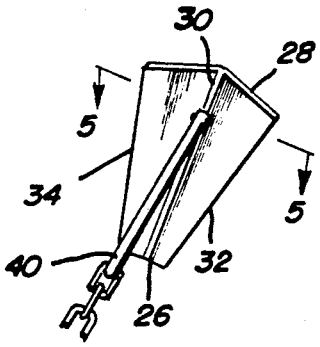
FIG. 4 is a rear perspective view of a bow anchor of the invention.
Figure 8:
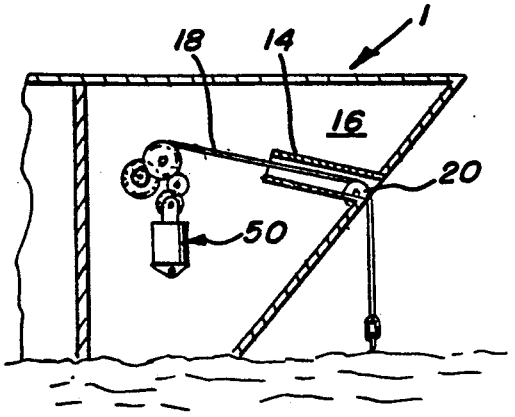
FIG. 8 is a sectional view of a boat hull showing the invention.

Referring to the drawing, there is a shown in FIGS. 1 and 2 of a boat hull 1. The boat hull 1 shown is a planing hull, however, the hull may be a planing hull, displacement hull or another type of hull. The only hull requirement is that the bow 12 must be able to accept the anchor and the housing system of the invention. The bow 12 shown in FIGS. 1, 2 and 8 is a planing hull bow with the usual planing hull configuration, which works well with a bow anchor 10. The incline angle $\alpha$ allows the anchor 10 to be payed out and retrieved without striking the bow.

A slightly inclined conduit 14 with a pay out roller 20 guides the bow anchor 10 and its anchor line 18. The conduit 14 is angled toward the bow 14 to allow the weight of the anchor 10 to pay the anchor line 18 out. When the anchor line is retrieved it is wound in by a winch mechanism over the roller 20 without very much, if any contact with conduit 14. The conduit 14 extends into the boat hull 1 and then into an area commonly referred to as an anchor locker 16.

In FIG. 2, the anchor 10 is also shown in phantom line 10' as it is retracted against the bow 14.

The bow anchor 10 shown in FIGS. 3–6 is a plough type anchor with a plough blade body 24 and a pivotal arm 40. Plough blade 24 has an elongated shape which conforms to the shape of the bow 12. The lower end 26 of the anchor blade body 24 is narrower than the upper end 28 which provides the blade with balance as it digs in the ocean floor.

Figure 5:
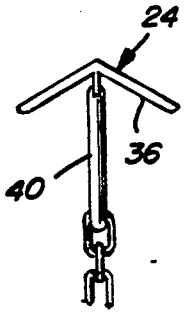
FIG. 5 is a top plan view taken along the line 5—5 of FIG. 4.
Figure 6:
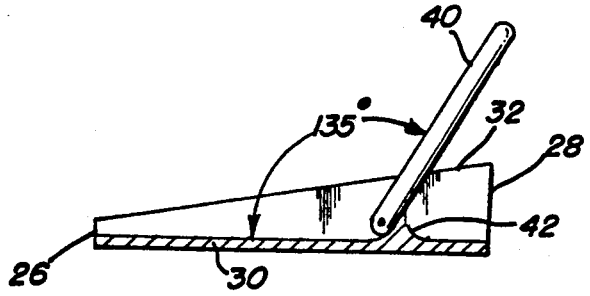
FIG. 6 is a cross sectional view taken along the line 6—6 of FIG. 3.

The anchor blade body 24 has a pair of wings 32 and 34 separated by a center line 30. The wings 32 and 34 form a triangular shape, FIG. 3. Further FIG. 5 shows the wings having a V-shape cross section. Pivotal arm 40 is connected to a pivot at or about one-fourth of the length of the blade body from the upper end 28 on the inside of the V-shaped cross section and along the center line 30. There is a stop 42, FIG. 6, to prevent the arm 40 from pivoting beyond 135 degrees, using the center line 30 as one leg of the angle and the arm 40 as the other and measuring from the lower end 26. Limiting the pivotal movement of arm 40 locks the blade body 24 at an angle approximating angle A of the hull bow 12.

As the anchor 10 is lowered in the water the wings and the V-shape cross section balance the blade body 24 in a somewhat vertical position. Water rushing over the inside surface 36 is pushed outwardly and upwardly over the wings 32 and 34, due in part to the movement of the water action and movement of the boat. Also aiding in balancing the blade body 24 is the mass distribution of the body 24. The upper end 28 has the greater amount of weight which stabilizes the blade body 24 as the water moves upwardly and outwardly over the wings 32 and 34. The mass distribution also aids in setting the anchor 10 in the ocean floor. As the lower end 26 digs in, the weight of the upper end 28 forces the lower end downward to bury it in sand, mud, rocks or whatever is on the ocean bottom.

Figure 7:
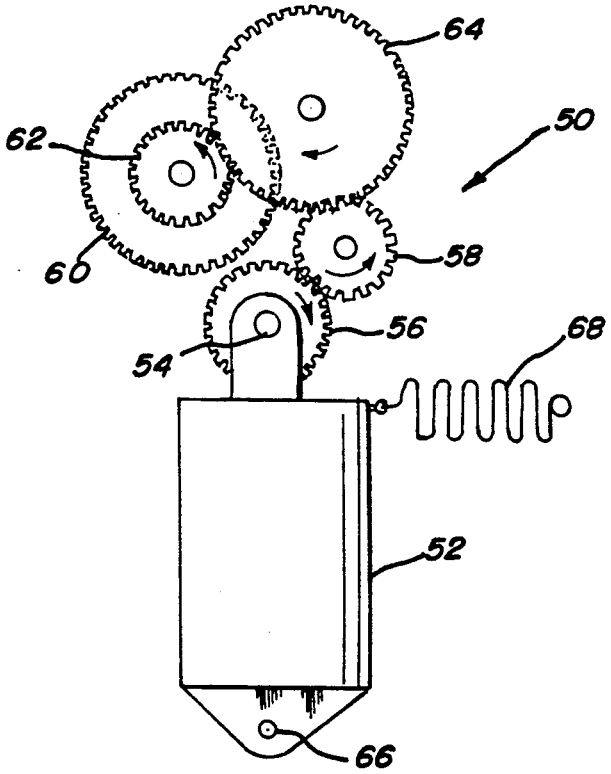
FIG. 7 is a side view of a winch mechanism of the invention.

Turning to FIGS. 2, 7 and 8, they show a winch mechanism 50 for paying out and retrieving the anchor line 18. There is shown in FIG. 7 a gear motor 52, which connects to an electrical source, not shown. Connected to the output shaft 54 of the motor 42 is a drive gear 56. Drive gear 56 will connect to one of two driven gears 58 or 60. Gear 58 is a high speed gear having a gear ratio with drive gear 56 of 1.5 to 1. The other gear 60 is a low speed gear having a gear ratio with drive gear 56 of 1 to 3. Affixed to gear 60 is a smaller gear 62 which will turn a winch gear 64. High speed gear 58 will also turn the winch gear 64. Either gear 58 or 62 will turn winch gear 64, depending on which gear drive gear 56 is turning, gear 60 or gear 58. Obviously, when drive gear 56 is connected to high speed gear 58 the winch gear 64 turns faster, and when drive gear 56 is connected to low speed gear 60 the winch gear turns slower.

Ordinarily, gear motor 52 is connected to high speed gear 58. This is because the motor 52 is pivoted about pivot 66 and is held in contact in position by tension spring 68 to maintain contact between gears 56 and 58. If the load on winch gear 64 becomes too great, the motor 52 is pivoted toward gear 60 to engage it and drive gear 56. When drive gear 56 is moved from one driven gear to the other it is momentarily engaged with both gears to continue turning winch gear 64. AS the load decreases on winch gear 64, the gear motor 52 switches back to gear 58. Motor 52 is reversible to pay out or retrieve anchor line 18.

In operation, the winch mechanism 50 pays anchor line 18 out through conduit 14 over roller 20. The weight of anchor 10 pulls the anchor line 18 as the anchor 10 lowers into the ocean until it contacts the ocean floor. As explained, the anchor blade body 24 is balanced to retain its vertical position while lowering to the ocean floor. The anchor sets itself on the ocean floor until it is dislodged or retracted in the bow of the boat hull 1. When the winch mechanism has retracted the anchor line 18, the anchor arm 40 is drawn up into the conduit 14 and the plough-like blade 24 is drawn against the bow and fitted thereagainst to resemble the shape of the hull.

While only one embodiment of the invention has been described, it is understood that one skilled in the art may realize other embodiments. Therefore one should consider the drawings, specification and claims for a complete understanding of the invention.

What is claimed is:

1. A bow anchor for mounting on the bow of a boat hull and having an anchor blade having a configuration that conforms to the shape of the bow of the hull to give the anchor on the bow a low profile appearance comprising:

a conduit means mounted on the bow of the hull and extending through the hull, said conduit means being inclined toward the bow and having a roller means positioned at the end of conduit means end nearest the bow, a winch mechanism inside said hull for operating an anchor line to pay said anchor line through said conduit means, and to retract the anchor line through said conduit means, said anchor connected to the anchor line for lowering and raising according to the direction of movement of said anchor line, said anchor having a generally triangular shape in plan view and a V-shaped cross section perpendicular to said triangular shape to provide a plough blade means and a pivotal arm means connected to said plough blade means, where said plough blade means is shaped to fit close to said boat hull bow to conform to the shape of said bow.

2. A bow anchor as in claim 1 wherein said arm means is connected to the inside of said V-shape at about one-fourth the distance of the length of said triangular shape, measuring from the base end to the apex end along a center between the two ends.

3. A bow anchor as in claim 2 wherein said arm means is pivotally connected to a pivotal connection on said inside of said V-shape.

4. A bow anchor as in claim 3 wherein said pivotal connection has a stop means to limit the pivoting of said arm means.

5. A bow anchor as in claim 4 wherein said stop means limits the pivoting of said arm means between 0 and 135 degrees, measuring along the center between the base end and apex end of said triangular shape of said plough blade means.

6. A bow anchor as in claim 5 wherein said apex end is cut off to form a flat portion.

7. A bow anchor as in claim 6 wherein said winch mechanism includes a high speed means and a low speed means to operate a winch gear, and a motor means pivotal between said high and low speed means.

* * * * *